US005136208A

United States Patent [19]

Kawashima et al.

[11] Patent Number: 5,136,208

[45] Date of Patent: Aug. 4, 1992

[54] METAL HALIDE LAMP MAINTAINING A HIGH LUMEN MAINTENANCE FACTOR OVER AN EXTENDED OPERATION PERIOD

[75] Inventors: Hiromichi Kawashima, Kawasaki; Kazuo Honda, Hiratsuka; Youichiro Mitsuyuki, Tokyo; Yasuki Mori, Yokohama; Masakazu Shibuya, Yokosuka; Mamoru Furuya, Miura, all of Japan

[73] Assignee: Toshiba Lighting & Technology Corporation, Tokyo, Japan

[21] Appl. No.: 476,036

[22] Filed: Feb. 7, 1990

[30] Foreign Application Priority Data

Feb. 7, 1989 [JP] Japan ..... 1-028039
Jul. 31, 1989 [JP] Japan ..... 1-196745

[51] Int. Cl.[5] ..... H01J 17/20; H01J 61/20

[52] U.S. Cl. ..... 313/641; 313/639; 313/640; 313/642

[58] Field of Search ..... 913/639, 640, 641, 642, 913/633

[56] References Cited

U.S. PATENT DOCUMENTS 4,171,498 10/1979 Fromm et al. ..... 313/641

FOREIGN PATENT DOCUMENTS 43-5158 2/1968 Japan .

*Primary Examiner*—Donald J. Yusko
*Assistant Examiner*—Diab Hamadi
*Attorney, Agent, or Firm*—Cushman, Darby & Cushman

[57] ABSTRACT

A prescribed amount of tin halide is sealed in the arc tube of a metal halide lamp wherein a given amount of metal halide including a target amount of halogen and at least a predetermined amount of rare earth metal is sealed in the arc tube thereof to maintain a high lumen maintenance factor for an extended operation period. The prescribed amount of tin halide is preferably within 4.6~234 mol % of the predetermined amount of rare earth metal.

4 Claims, 3 Drawing Sheets

METAL HALIDE LAMP MAINTAINING A HIGH LUMEN MAINTENANCE FACTOR OVER AN EXTENDED OPERATION PERIOD

BACKGROUND OF THE INVENTION

1. Field of the invention

The present invention relates, in general, to high intensity discharge lamps. In particular, the invention relates to a metal halide lamp in which a rare earth halide is sealed in the arc tube, as a luminous metal.

2. Description of the related art

A high intensity discharge lamp, i.e., a so-called HID lamp, has been used as an outdoor lighting, etc. However, in recent years, the high intensity discharge lamp is further used as a light source of projectors or as an indoor lighting of stores. The above-described extended use of the high intensity discharge lamp is promoted by the miniaturization of the lamp.

In a conventional high intensity discharge lamp, opposite ends of an arc tube thereof are pinched to form respective bases (a double base type) in which a pair of electrodes are supported. Thus, the external size of the arc tube is large, as compared with the discharge space of the arc tube. Heat discharge from the bases of the arc tube also is large, resulting in the increase in heat loss of the lamp. To solve the above-described problems, a single base type arc tube is employed in the conventional high intensity discharge lamp. A pair of electrodes are supported in the single base. Thus, heat loss of the arc tube including the single base is reduced, and the external size thereof also is reduced, as compared with the arc tube which has two bases.

A high intensity discharge lamp may be a mercury lamp, a metal halide lamp, or a high pressure sodium lamp. The conventional high intensity discharge lamp has a high efficiency, and a high light output. The conventional high intensity discharge lamp also has a high brightness, and a high color rendering property. In particular, a metal halide lamp has a high efficiency and a high color rendering property, as compared with other types of the conventional high intensity discharge lamp. Furthermore, a metal halide lamp in which a rare earth halide, e.g., dysprosium (Dy), is sealed in the arc tube thereof as a luminous substance has a higher efficiency and a higher color rendering property, as compared with a metal halide lamp in which other metal halide, e.g., sodium (Na), is sealed in the arc tube thereof. However, in the above-described metal halide lamp in which the rare earth halide is sealed in the arc tube thereof, an operation life thereof is relatively insufficient. Thus, it is undesirable to use the above-described metal halide lamp as a light source of ,e.g., projector, because of the insufficient operation life. The wall loading of the above-described metal halide lamp is designed at a high level, e.g., 20~70 w/cm$^2$, to achieve a high output in spite of a small external size thereof. Thus, the temperature of the arc tube made of quartz glass tends to increase. In addition, an excess amount of the rare earth halide is sealed in the arc tube, as compared with an amount thereof which is needed during the operation. Thus, the excess amount of the rare earth halide, in particular dysprosium (Dy), reacts on the silicon element contained in the arc tube of a high temperature during the operation, and the arc tube tends to lose the transparency. If the loss of the transparency of the arc tube extremely proceeds, in the event, bursting of the arc tube may occur. Furthermore, the excess amount of the rare earth halide causes spattering of the electrode material, i.e., tungsten, during the operation. Thus, the arc tube will become black faster than usual, or the lamp voltage will increase, resulting in the decrease in lumen maintenance factor of the lamp. In particular, the lumen maintenance factor of the conventional metal halide lamp wherein dysprosium is sealed in the arc tube decreases to 50% after 500 hours operation.

SUMMARY OF THE INVENTION

Accordingly, it is an object of the present invention to maintain a high lumen maintenance factor of a metal halide lamp for an extended operation period.

To accomplish the above-object, a metal halide lamp includes an arc tube device for radiating light, a fill including a proper amount of mercury and rare gas sealed in the arc tube device, a given amount of metal halide including a target amount of halogen and at least a prescribed amount of rare earth metal, sealed in the arc tube device, which is in the form of rare earth metal halide, and a predetermined amount of tin halide sealed in the arc tube. The prescribed amount of tin halide may be within 4.6~234 mol % of the prescribed amount of rare earth metal halide.

The halogen of the metal halide may include at least iodide, which is sealed in the arc tube device in the form of a metal iodide. A weight ratio between the metal iodide and the metal halide excuding the metal iodide may be within the range of 1:0.2~1:5.

BRIEF DESCRIPTION OF THE DRAWINGS

These and other objects and advantages of this invention will become more apparent and readily appreciated from the following detailed description of the presently preferred exemplary embodiment of the invention, taken in conjunction with the accompanying drawings, wherein like reference numerals throughout the various figures denote like structure elements and wherein.

DETAILED DESCRIPTION OF THE PREFERRED EMBODIMENT

Figure 1:
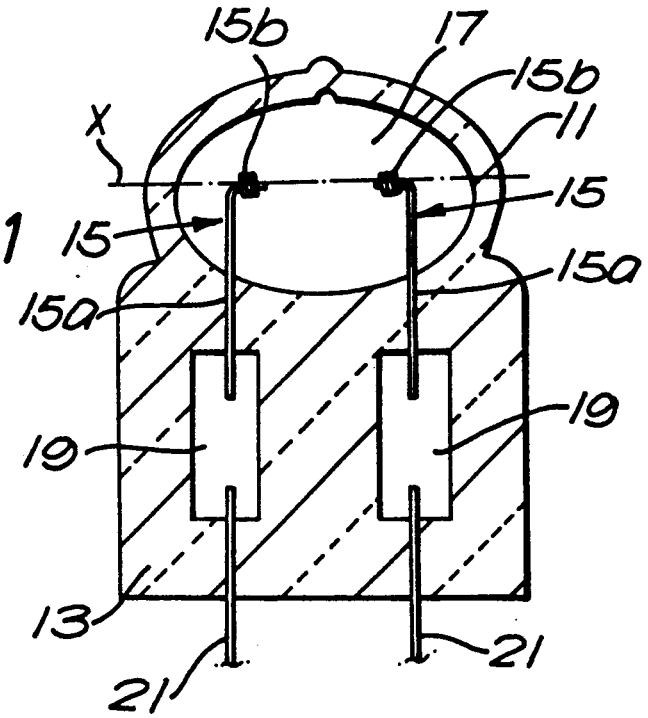
FIG. 1 is a cross sectional view illustrating a small sized metal halide lamp of one embodiment of the present invention.

A preferred embodiment of the present invention will now be described with reference to accompanying drawings. An arc tube of a 150W rating metal halide lamp is shown in FIG. 1. Arc tube 11 is normally enveloped by an outer jacket (not shown) of quartz glass to form a double bulb construction. Arc tube 11 is preferably made of quartz glass and is formed in an ellipsoidal shape. The bulb axis X of arc tube 11 extends in an elongated direction of the ellipsoidal shape. A sealed base 13 is formed in a direction perpendicular to the bulb axis X such that it is pinched in a flat shape, as shown in FIG. 1. A pair of electrodes 15, 15 is arranged opposite to one another in a discharge space 17 of arc tube 11. Each electrode 15 is composed of an electrode rod 15*a* and a coiled element 15*b*. One end of electrode rod 15*a* extends into sealed base 13, and the other end thereof is provided with coiled element 15*b* to increase the heat capacity of electrode 15. The other end of each electrode rod 15*a* is bent along the bulb axis X to oppose one another. In this embodiment, electrode rod 15*a* is formed with a rhenium-tungsten alloy wire whose diameter is 0.5 mm. Coiled element 15*b* is formed with thoriated tungsten whose diameter is 0.5 mm, and is wound around the bent portion of the other end of electrode rod 15*a* three or four times. The distance between the opposed ends of electrode rods 15*a*, 15*a* is maintained at 6~8 mm. The one end of each electrode rod 15*a* is connected to a molybdenum foil 19 disposed in sealed base 13, respectively. A pair of external lead wires 21, 21 is connected to the corresponding molybdenum foils 19 in sealed base 13.

A proper amount of rare gas and mercury are sealed in arc tube 11. A prescribed amount of a metal halide is also sealed in arc tube 11, as a luminous metal. The metal halide includes a rare earth halogen, e.g., dysprosium ($DyI_3$), holmium ($HoI_3$) and thulium ($TmI_3$). The metal halide also includes cesium (CsI) and thallium (TlI). In addition, tin halide, e.g., $SnI_2$, is sealed in arc tube 11. Sealed ratio (wt %) of each halide is as follow: $DyI_3$:$HoI_3$:$TmI_3$:CsI:TlI=20:21:22:17:20. Total amount of the rare earth halides sealed in arc tube 11 is 2.0 mg/cc. The amount of tin halide ($SnI_2$) sealed in arc tube 11 is 0.5 mg/cc. The inner surface area of the above-described arc tube 11 is about 4.6 $cm^2$, and the lamp load thereof for a unit surface area is about 42 $w/cm^2$.

The initial characteristics of the metal halide lamp including the above-described arc tube 11 are shown in the following table I.

TABLE I

| | |
|---|---|
| Lamp voltage | 98 (V) |
| Lamp current | 1.8 (A) |
| Lamp power | 150 (W) |
| Total luminous flux | 13500 (lm) |
| Lamp efficiency | 90 (lm/w) |
| Correlation color temperature | 5000 (K) |
| Average color rendering index | 85 (RA) |

Figure 2:
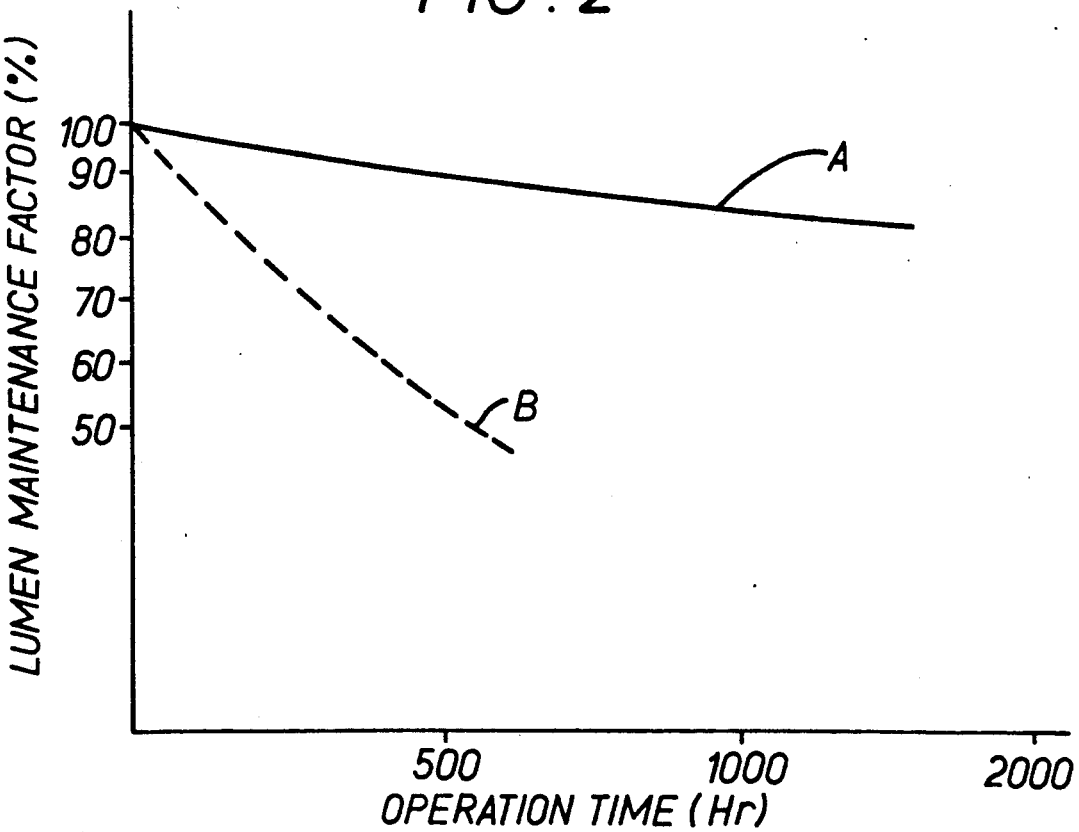
FIG. 2 is a graph showing changes in each lumen maintenance factor of the metal halide lamp of one embodiment and the conventional metal halide lamp with respect to the operation period.

An experiment was carried out to observe changes in lumen maintenance factor of the above-described metal halide lamp. The result of the experiment is shown in FIG. 2. In FIG. 2, changes in lumen maintenance factor of the metal halide lamp in which tin halide is sealed is indicated by a solid line A, and changes in lumen maintenance factor of the conventional metal halide lamp in which tin halide is not sealed is indicated by a dotted line B.

As can be seen in FIG. 2, the lumen maintenance factor of the conventional metal halide lamp decreases to 50% after 500 hours continuous operation. On the other hand, in the metal halide lamp of one embodiment, the lumen maintenance factor thereof decreases to 85% after 1000 hours continuous operation. This result shows an extended operation life of the metal halide lamp of one embodiment.

The theory of the above-described phenomenon is not yet fully understood. The current thinking as to why the operation life of the metal halide lamp including the prescribed amount of tin halide extends will be explained below. Tin halide controls the creation of silicon halide which results from the reaction between silicon element in arc tube 11 and the rare earth halide, e.g., dysprocium. Tin halide may also control the accumulation of silicon halide on the pair of electrodes 15, 15. It may be avoided that the pair of electrodes 15, 15 become breakable. Thus, the amount of tungsten spattered from the pair of electrodes 15, 15 reduces, resulting in the decrease in accumulation of tungsten on the inner surface of arc tube 11, as compared with the conventional metal halide lamp.

In the above-described one embodiment, the invention is applied to a metal halide lamp which has a single sealed base. However, the invention may be applied to a metal halide lamp which includes double sealed bases. In sum, the invention may be applied to a metal halide lamp whose wall loading is 20~70 $w/cm^2$, preferably 20~50 $w/cm^2$.

The sealed ratio (mol) of tin halide to rare earth halide is preferably 4.6~234%. If the sealed ratio is less than 4.6%, it is difficult to avoid both the loss of transparancy of arc tube 11 and the accumulation of tungsten on the inner surface of arc tube 11. On the other hand, if the sealed ratio of tin halide is more than 234%, the lamp efficiency and the color temperature of arc tube 11 are decreased.

The above-described effects of the one embodiment are significant when the rare earth halide includes dysprocium. However, similar effects to the one embodiment may be achieved even though the rare earth halide does not include dysprocium. In the one embodiment, dysprocium is sealed in arc tube 11 in the form of iodide, i.e., $DyI_3$. However, dysprocium may be sealed in arc tube 11 in the form of bromide, i.e., $DyBr_3$. Tin halide is sealed in arc tube 11 in the form of iodide, i.e., $SnI_2$, in one embodiment. However, tin halide may also be sealed in arc tube 11 in the form of bromide, i.e., $SnBr_2$.

A second embodiment of the present invention will now be described.

In a metal halide lamp, a color temperature difference occurs between at the center and the boundary of arc generated in the arc tube when only iodide is used as halogen and is sealed in the arc tube in the form of rare earth iodide. However, the color temperature difference in arc can be reduced when at least two different kinds of halogen. e.g.. iodide and bromide, are sealed in the arc tube. Thus, the color irregularity of light radiated from the metal halide lamp is greatly improved when the metal halide lamp is used as a light source of a projector.

In this embodiment, a rare earth halide is sealed in the arc tube, as a metal halide. Particularly, at least two different kinds of halogen, e.g., iodide and bromide, are sealed in the arc tube. Furthermore, rare earth metals, e.g., dysprocium (Dy), holmium (Ho), thulium (Tm), are also sealed in the arc tube. That is, dysprocium iodide ($DyI_3$), holmium iodide ($HoI_3$), and thulium iodide ($TmI_3$) exist in the arc tube. Dysprocium bromide ($DyBr_3$), holmium bromide ($HoBr_3$), and thulium bromide ($TmBr_3$) also exist in the arc tube. It should be noted that a prescribed amount of tin halide is also sealed in the arc tube to maintain a high lumen maintenance factor. In this case, the total amount of rare earth halide in the arc tube is 2.0 mg/cc. The weight ratio between rare earth metal iodide and rare earth metal bromide is 1:0.5. The initial characteristics of the above-described metal halide lamp are shown in the following table II.

TABLE II

| | |
|---|---|
| Lamp voltage | 84 (V) |
| Lamp current | 3.1 (A) |
| Lamp power | 220 (W) |
| Lamp efficiency | 75 (lm/w) |
| Correlation color temperature | 5000 (K) |
| Average color rendering index | 85 (Ra) |

Figure 3:
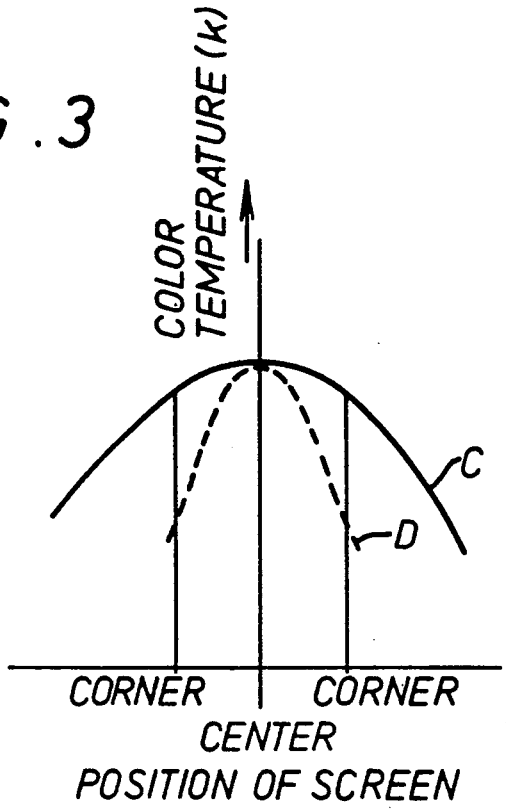
FIG. 3 is a graph showing each color temperature distribution of the metal halide lamp of a second embodiment and the conventional metal halide lamp.

An experiment was carried out to observe the distribution of the color temperature of the metal halide lamp on the screen. The result of the experiment is shown in FIG. 3. In FIG. 3, a solid line C indicates the distribution of the color temperature of the metal halide lamp of the second embodiment and a dotted line D indicates the distribution of the color temperature of the conventional metal halide lamp. As can be seen in FIG. 3, difference in color temperature of the lamp of second embodiment at the center and the opposite side edges of the screen is greatly improved, as compared with the conventional metal halide lamp. Thus, the color irregularity formed on the screen can be significantly reduced. It may be surmised that the boundary of arc between the pair of electrodes is distinguished because of existence of both rare earth metal iodide and rare earth metal bromide in the arc tube. Thus, difference in color temperature between at the center of the arc and at the opposite edge of the arc in a radius direction is greatly reduced.

Figure 4:
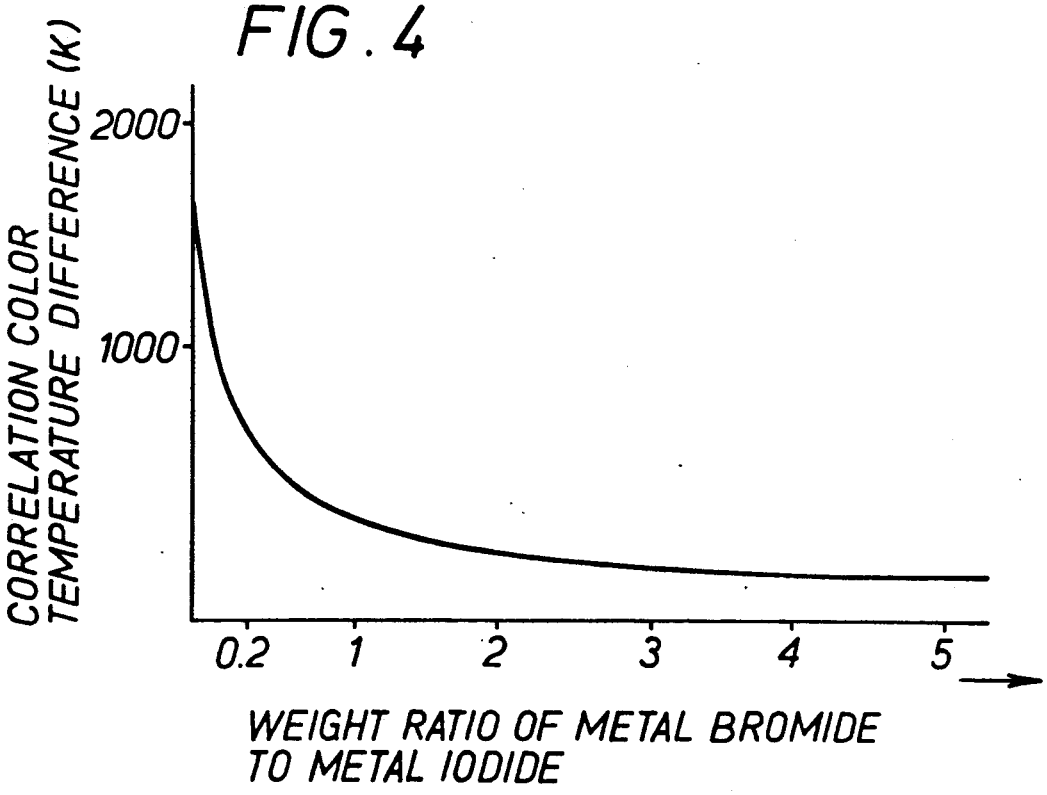
FIG. 4 is a graph showing changes in a correlation color temperature difference of the lamp of the second embodiment when the weight ratio of a metal bromide to a metal iodide is varied.

Inventors of the present invention carried out the observation of the relationship between the difference in correlation color temperature of light from the metal halide lamp of second embodiment and the weight ratio of rare earth metal bromide to rare earth metal iodide in the arc tube when the metal halide lamp is used as a light source of a projector. The result of the observation is shown in FIG. 4. Each correlation color temperature difference in FIG. 4 indicates the maximum diffrence between the color temperature at the center of the screen and color temperatures at the four corners of the screen.

Generally, in a projector, e.g., a liquid crystal projector device, a visible color temperature irregularity at a projection surface should be controlled at less than 1000K. Thus, as can be understood from FIG. 4, the weight ratio of the rare earth metal bromide to the rare earth metal iodide should be regulated at more than 0.2.

Figure 5:
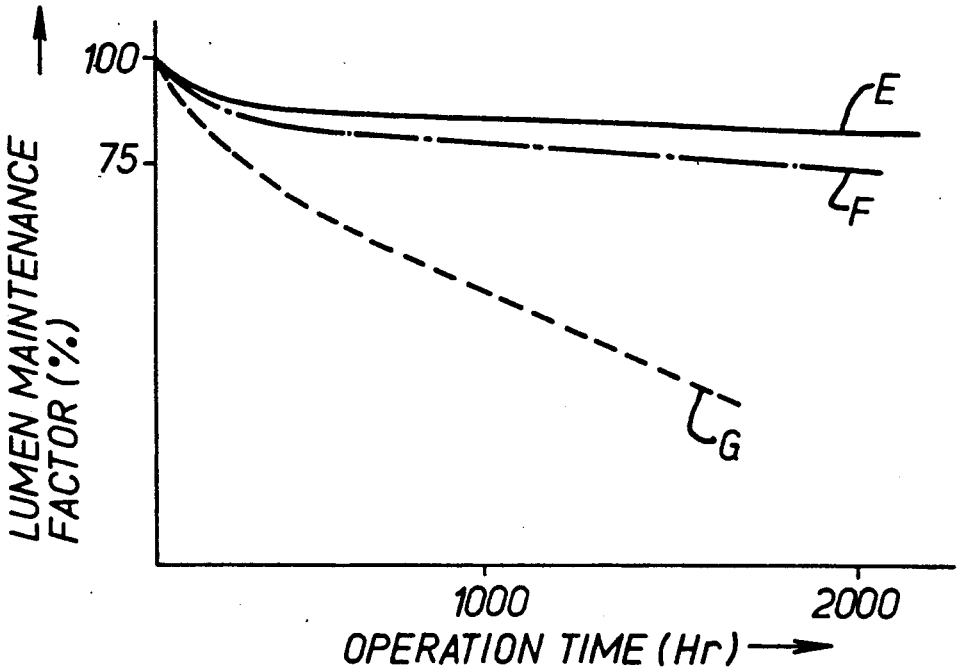
FIG. 5 is a graph showing changes in a lumen maintenance factor of the metal halide lamp of the second embodiment when the weight ratio of a metal bromide to a metal iodide is varied.

Another experiment was carried out to observe changes in lumen maintenance factor of three different lamps wherein the weight ratio between the rare earth metal iodide and the rare earth metal bromide in each lamp is different from one another. In a first lamp, the weight ratio is set at 1:0. In a second lamp, the weight ratio is set at 1:5. The weight ratio of a third lamp is set at 1:10. Results of the experiment are shown in FIG. 5. In FIG. 5, changes in lumen maintenance factor of the first lamp is indicated by a solid line E. Changes in lumen maintenance factor of the second lamp is indicated by a dotte and dashed line F, and changes in lumen maintenance factor of the third lamp is indicated by a dotted line G.

As can be seen in FIG. 5, there is a distinct tendency to decrease in the lumen maintenance factor when the weight ratio between the rare earth metal iodide and the rare earth metal bromide is increased. It is required for the lamp to maintain the lumen maintenance factor of more than 60% after 2000 hours operation when the practical operation life of the lamp is taken into consideration. The above-described requirement of the lumen maintenance factor can be satisfied when the weight ratio of the rare earth metal bromide against the rare earth metal iodide is set at less than five. As can be understood from the above description, the lumen maintenance factor and the color irregularity of light from the metal halide lamp can be greatly improved when the weight ratio between the rare earth metal iodide and the rare earth metal halide excluding metal iodide is selected from the range of 1:0.2~1:5. A similar result to the above-described experiment also was observed when chlorine is sealed in the arc tube, as halogen element, instead of bromide.

With the present invention, a high lumen maintenance factor of the metal halide lamp including rare earth halide can be maintained for an extended operation period when a prescribed amount of tin halide is sealed in the lamp. A color irregularity of light radiated from the metal halide lamp including a metal iodide and a metal halide excluding the metal iodide can be improved when the weight ratio between the metal iodide and the metal halide excluding the metal iodide is controlled within a prescribed range.

The present invention has been described with respect to specific embodiments. However, other embodiments based on the principles of the present invention should be obvious to those of ordinary skill in the art. Such embodiments are intended to be covered by the claims.

What is claimed is:

1. A metal halide lamp comprising:

an arc tube defining an inner space for radiating light;

a fill including mercury and rare gas in the inner space of the arc tube;

a predetermined amount of a non-sodium metal halide including a target amount of halogen and at least a prescribed amount of rare earth metal in the inner space of the arc tube, the rare earth metal being in the inner space in the form of rare earth metal halide; and a predetermined amount of tin halide in the inner space of the arc tube;

wherein the predetermined amount of tin halide is within 4.6–234 mol % of the prescribed amount of rare earth metal halide.

2. A lamp according to claim 1, wherein the arc tube includes a pair of electrode means for generating arc in the inner space.

3. A lamp according to claim 2, wherein the halogen of the metal halide includes at least iodide, a part of the given amount of the metal halide being in the inner space of the arc tube means in the form of a metal iodide.

4. A lamp according to claim 3, wherein a weight ratio between the metal iodide and the metal halide excluding the metal iodide is within the range of 1:0.2~1:5.

* * * * *